United States Patent [19]

Krecke

[11] Patent Number: 4,655,014

[45] Date of Patent: Apr. 7, 1987

[54] FORMWORK ASSEMBLY FOR CONCRETE WALLS

[76] Inventor: Edmond D. Krecke, 15-17, Route de Grundhof, 6315 Beaufort, Luxembourg

[21] Appl. No.: 702,040

[22] Filed: Feb. 15, 1985

[30] Foreign Application Priority Data

Feb. 17, 1985 [DE] Fed. Rep. of Germany ..... 3405736

[51] Int. Cl.[4] ..... E04B 1/02

[52] U.S. Cl. ..... 52/105; 52/309.12; 52/426; 52/427; 52/563

[58] Field of Search ..... 52/562, 563, 564, 571, 52/570, 426, 427, 428, 595 R, 105; 249/18 R, 40, 41, 1

[56] References Cited

U.S. PATENT DOCUMENTS

| | | | |
|---|---|---|---|
| 929,969 | 8/1909 | Murray | 52/564 |
| 2,185,335 | 1/1940 | Fischer | 52/563 |
| 3,233,380 | 2/1966 | Rosenfeld | 52/427 |
| 3,255,562 | 6/1966 | Altschaler | 52/427 |
| 3,562,988 | 2/1971 | Gregoire | 52/570 |
| 4,234,156 | 11/1980 | Wepf | 249/41 |

FOREIGN PATENT DOCUMENTS

| | | | |
|---|---|---|---|
| 245208 | 2/1966 | Austria | 52/426 |
| 1299839 | 7/1969 | Fed. Rep. of Germany | 52/428 |
| 730,009 | 8/1932 | France | 52/563 |
| 857,507 | 9/1940 | France | 52/426 |
| 1299616 | 6/1962 | France | 52/426 |
| 289601 | 3/1953 | Switzerland | 52/427 |
| 137,221 | 1/1920 | United Kingdom | 52/426 |

*Primary Examiner*—Henry E. Raduazo

*Attorney, Agent, or Firm*—Gifford, Groh, VanOphem, Sheridan, Sprinkle and Dolgorukov

[57] ABSTRACT

In a formwork assembly for concrete wall structures side wall portions are provided at their edges with grooves and projections engageable therein for securing side wall portions together in a proper position, with the side wall portions being connected by connecting members and possibly end wall portions as required. On their inside surface, each side wall portion has engagement means to which the connecting members can be secured in the appropriate position. The engagement means may be formed by interengaging recesses and raised portions, ball portions and ball-receiving sockets or shallow detent grooves. Adhesive may also be employed for additional strength. The side wall portions may be used as insulating panels for walls, roof and floors.

16 Claims, 18 Drawing Figures

FIG. 6
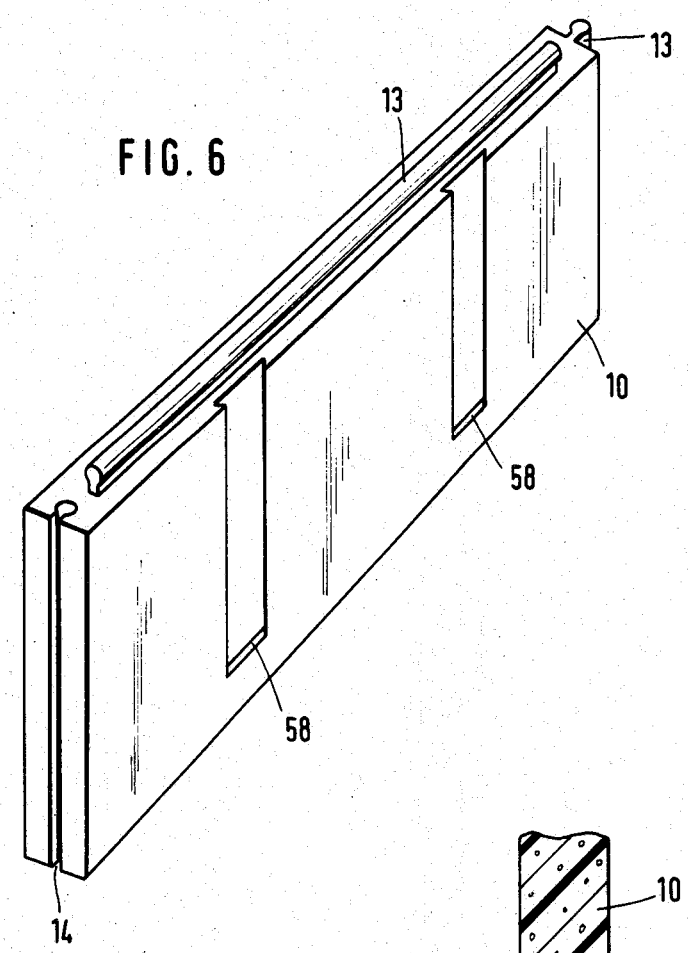
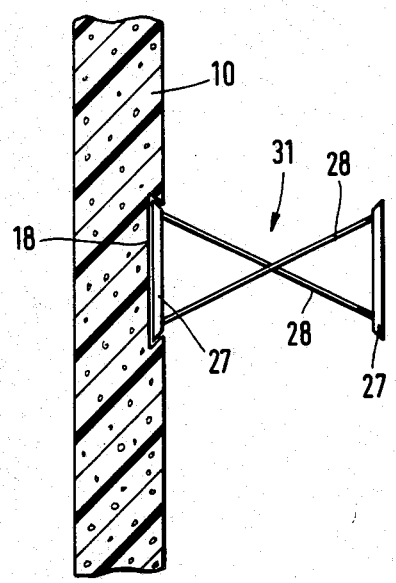
FIG. 7

FIG. 15
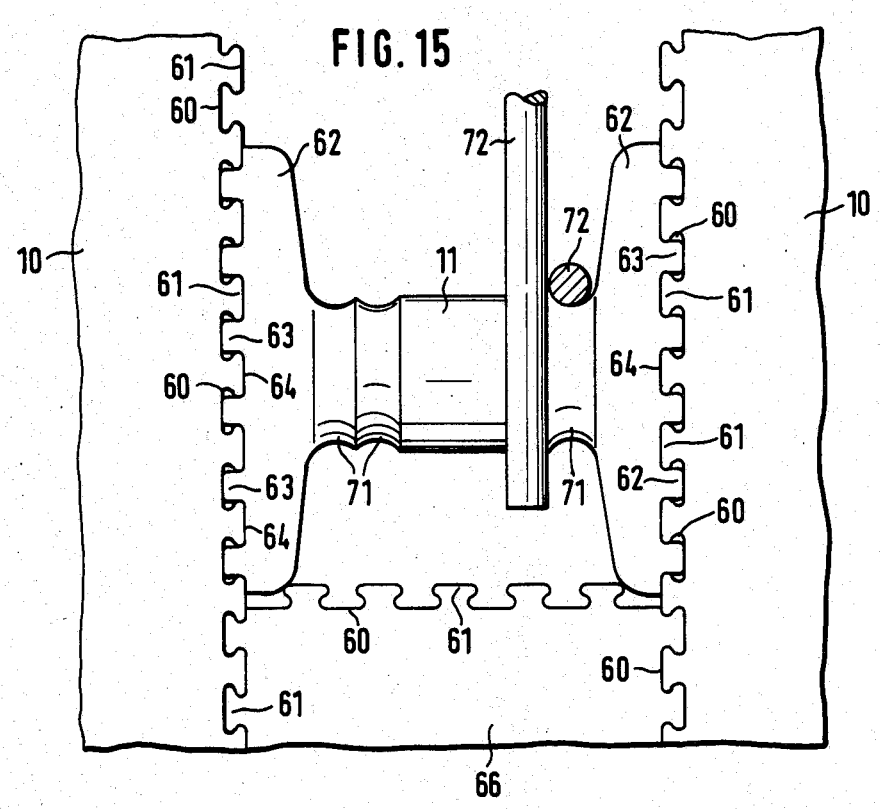
FIG. 16
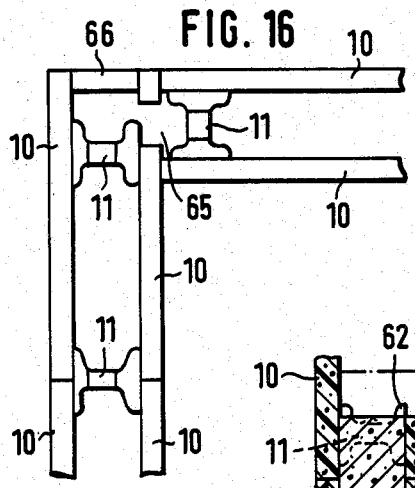
FIG. 17
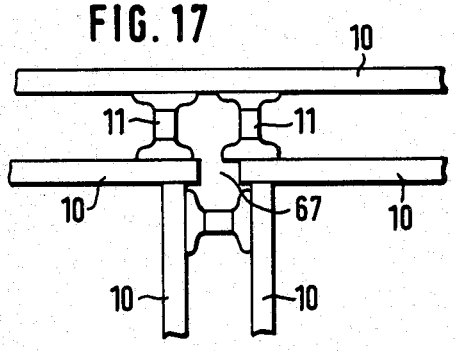
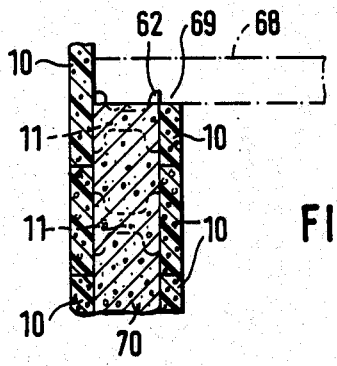
FIG. 18

FORMWORK ASSEMBLY FOR CONCRETE WALLS

BACKGROUND OF THE INVENTION

The present invention relates generally to a formwork or shuttering assembly for the encased concrete construction system.

One known form of such an assembly is made up of side walls and optionally end walls, to be disposed at the appropriate locations, wherein the walls are provided at their edges with grooves and projections which are capable of interengaging for securing the walls in position relative to each other, with the side walls being connected together by bars or tie members. The walls comprise for example a hard plastic foam material. A largescale assembly of that nature, as disclosed for example in German published specification (DE-AS) No. 26 18 215, may be used in many situations and permit buildings to be erected quickly and at low cost, while also providing good external and internal thermal insulation, with the side walls thus acting as a form of cladding.

However, various disadvantages are often found with the known forms of such assemblies, more particularly having regard to the wide range of requirements which are to be made in respect thereof. For example, where the connecting bars or tie members comprise for example a hard foam, being produced in one piece with the side walls for example, there is the possibility of fire striking through the wall along the tie members. On the other hand, in such an assembly as disclosed for example in U.S. Pat. No. 4,223,501, the tie members are in the form of metal grid or lattice members or sheet metal members which are fitted into the mould during manufacture of the assembly. That is a difficult and complicated operation, while also giving rise to what are known as cold bridges through the wall, because the metal members, in order to provide a secure anchoring action, terminate comparatively close to the outside surface of the wall built with the assemblies. In an assembly as disclosed in U.S. Pat. No. 3,788,020, the tie members are in the form of sheet metal members which are subsequently fitted into pre-formed slots or grooves in the side walls of the assembly, which results in the side walls being considerably weakened due to the provision of the slots or grooves, while also permitting the formation of cold bridges.

There are therefore a number of aspects in which improvement in the above-discussed assemblies would be desirable, while nonetheless the assemblies remain strong and stable, having regard to the concrete filling which is introduced thereinto and which may frequently extend over the height of a complete story, as well as being capable of resisting internal and external loadings applied thereto and providing inexpensive manufacture and easy transportation by virtue of not taking up a great deal of space.

SUMMARY OF THE INVENTION

An object of the present invention is to provide a formwork or shuttering assembly for concrete construction systems, which at least substantially overcomes difficulties and disadvantages encountered in the prior-art arrangements.

Another object of the present invention is to provide a formwork assembly which can be used in a wide range of different situations and which permits ready adaptation thereto.

Yet another object of the present invention is to provide a formwork assembly which can be produced at relatively low cost with short manufacturing cycle times while being capable of withstanding high levels of loading, more particularly when being filled with concrete.

A further object of the present invention is to provide such an assembly which also permits use thereof as heat barrier or insulation plates or panels for different situations of use.

Still a further object of the present invention is to provide a formwork assembly which takes up a comparatively small amount of space in regard to transportation and storage thereof.

These and other objects are achieved by means of an assembly in accordance with the principles of this invention, comprising side wall portions having grooves and projections at respective edges thereof for positional securing thereof relative to other such side wall portions. In the assembled condition, the side wall portions are interconnected by connecting means such as bars or like tie members, and the side wall portions may also optionally be interconnected by end wall portions at the appropriate locations.

Each side wall portion is provided on its inwardly facing surface, being therefore the surface which faces towards another side wall portion in the assembled condition thereof, with engagement means engageable by suitable engagement means provided on the tie members, to secure the components in the appropriate relative positions.

As will be seen in greater detail hereinafter, the construction in accordance with the invention as set forth in broad terms above permits the side walls and the tie members to be produced separately and thus possibly from different materials. That means that the manufacturing moulds are simpler and less expensive, and permits short manufacturing cycle times. The material used for the tie members may be a material which has a high degree of strength and resistance to heat, for example reinforced concrete, so that the side walls withstand a high internal pressure within the assembly when the concrete is being introduced thereinto. That construction at least substantially eliminates the danger of fire striking through the concrete wall, in contrast to the above-discussed tie members which comprise for example hard foam and which are produced in one piece with the side wall portions. Furthermore, the storage and transportation expenditure remains at a low level because the individual components can be left in a disassembled condition until they reach the building site or possibly for example a regional storage centre, when they can be readily assembled to put them into a condition for use. That is also in contrast with the assembly discussed above wherein the tie members are in the form of metal grid or lattice members or sheet metal members which are incorproated into the side wall portions in the course of manufacture thereof, which means that the assembly, being produced in the ready-for-use form, is bulky and cumbersome.

In addition, the material used for the tie members may be such as to substantially eliminate the risk of acoustic bridges, so that the need for sound-proofing materials on the constructions which are built with the assembly according to the present invention can be at least substantially reduced.

The side wall portions, tie members and end or intermediate wall portions, as well as the way in which those components are suitably secured together to constitute the final assembly, may be the subject of many different variations. Thus, in a preferred embodiment of the invention, the engagement means on the side wall portions are formed by a shallow depression or recess of a cross-section providing undercut edges, while the tie member comprises a co-operating portion which is of a corresponding configuration so that it can be brought into retaining engagement therewiht. Conversely, the engagement means on the side wall portions may also be formed by a shallow raised portion of a cross-section such as to provide an undercut edge configuration, on to which a co-operating portion on the tie member, of suitable configuration, may be brought into latching engagement. Thus, that arrangement provide a form of snap-in or snap-on or clipping connection between the side wall portion on the one hand and the tie member or other like component on the other hand, the undercut edge configurations ensuring that the two components being joined together are drawn towards each other by the wedge-like action of the undercut edge configuration. In addition, an adhesive may be applied, as by spraying, before the components are brought into the engaged condition. The depression or the raised portion referred to above may be comparatively shallow, being for example from 2 to 5 mm in depth or height respectively, so that there is virtually no weakening of the side wall portions. The actual configuration of the depression or raised portion, and the corresponding co-operating part of the tie member, may be adapted to the respective conditions involved. However, a circular shape has been found to be particularly desirable, although it is also possible for the depression to be for example in the form of a groove of dovetail-shaped cross-section, and similarly in regard to the raised portion or projection. With such an arrangement, one or more grooves or raised portions or projections may extend in a continuous manner to the upper edge and/or to the lower edge of the side wall portion, whereby the corresponding co-operating part of the tie member can be readily fitted thereinto. The exposed parts of the grooves or projections, which are therefore not occupied by the co-operating part of the tie member, provide an additional anchoring action by increasing the engagement between the side walls and the concrete which is poured into the formwork assembly, without the need to take any particular steps in that respect, such as forming further depressions or recesses in the internal surfaces of the side wall portions. It will also be appreciated that the junction between the side wall portions and the tie members is still firmly maintained even if for example an adhesive joint therebetween is no longer in a good condition, by virtue of the positive interengagement between the side wall portions and the tie members. For the purposes of correct positioning of the tie members or other like members, the groove or the projection on the side wall portion may be provided with suitable centering means.

In another advantageous embodiment of the invention, it is provided that the side wall portions and the tie member or like connector are interconnected by the interengagement of a ball portion provided on one component and a ball-receiving socket in the other component. The ball or the ball-receiving socket may be disposed on a raised portion on the respective component or at the bottom of a depression or recess in the respective component, such raised portion or recess preferably being of a circular configuration. In the case of a construction in which the tie members have respective contact surfaces at each of their two ends, such surfaces being formed as counterparts to the raised portion or depression on the respective side wall portion and/or the ball or ball-receiving socket respectively, it is possible for the surfaces which come into contact with each other in that way to be additionally secured together as by adhesive, over a substantial surface area, thus enhancing the connection therebetween. In that arrangement the ball portion and the socket in which it is received are desirably of such a configuration that, after they have been fitted together, there is a certain amount of tensile loading therebetween, which thus urges the co-operating surfaces more firmly into contact with each other and enhancing the adhesive join therebetween. In order further to increase the area of the surface available for making the adhesive join, the above-mentioned contact surfaces may be provided with enlargement portions which extend beyond the co-operating parts of the respecitve side wall portion and tie member.

In accordance with another development of the invention, the engagement means on a side wall portion may be formed by substantially equally spaced-apart grooves which extend from top to bottom of the respective side wall portion and which are distributed over the whole of the inside surface thereof. The grooves may be of square or rectangular cross-section or they may be of such a configuration that they are enlarged at their bottom, being for example in the form of a dovetail-shaped cross-section. An assembly which is made up of side wall portions of such a nature may be readily produced in virtually any desired length, or may be cut to the desired dimension, as required, by virture of the grooves extending continuously over the inside surface of the side wall portion and thus affording a ready form of adjustability in regard to relative positioning of the side wall portion and the tie member or members to be associated therewith. The grooves further enhance the interengagement between the side wall portions and the concrete introduced therewithin, thereby at least impeding the penetration of water into any gap between the side wall portion and the concrete, while in addition avoiding the possibility of noise being produced by virtue of the side wall portion flapping or striking against the concrete when set, by virture of the side wall portion being held securely against the concrete. Between each two grooves is formed a respective raised portion or land, the cross-section of which is advantageously complementary to the cross-section of the grooves. The resulting stepped or castellated configuration of the internal surface of the side wall portion has a shock-absorbing action when the concrete is being poured thereinto, in which respect it should be appreciated that the concrete often drops into the assembly formed by the side wall portions and the corresponding tie members, from a comparatively great height. In that case, individual lumps of concrete tend to be broken up by hitting the internal surface of the side wall portions, and do not impact against the side wall portions sufficiently to cause the assembly to be damaged or destroyed.

The side wall portions may preferably comprise a hard foam material, although it is also possible to use other materials. More particularly, it is possible for side wall portions of different natures to be joined together in the same assembly. For example, a hard foam side wall portion may be used on the outward side of the wall of a building, while a gypsum fibre panel may be used on the inward side. Other combinations, including using mineral insulating substances, are also possible.

The material used for the tie members is desirably such that, while giving a good and strong connection, it at least substantially eliminates the fear of fire striking through the wall. In an embodiment of the invention, the tie members comprise concrete at least in the region of their surfaces which bear against the respective side wall portions. A heavy concrete (vermiculite) is also particularly suitable in this case. When securing for example hard foam and concrete together as by adhesive, substantially shorter setting times are required than when using adhesive to join two hard foam components together, because the solvent can more quickly escape from the adhesive join. In order to enhance their tensile strength, the tie members may be provided in their middle region with one or more reinforcing bars which are either free or exposed or have concrete cast therearound. In a preferred embodiment, the tie members which comprise concrete also have coaxial holes or bores which extend thereinto from both ends and which terminate at a small spacing from each other. The portion of concrete which thus remains between the mutually adjoining ends of the two bores in each tie member eliminate the fear of fire striking through the tie member, but the remaining portion of concrete can also be easily drilled through at a later stage, for example for easily fitting fixing or support members or for passing pipes or other conduits therethrough. The operation of finding the correct location for that operation is particularly simplified when the side wall portions are provided with centering points or marking on their outside surface, thus identifying the positions of the tie members and possibly the bores or holes therein.

Tie members which are made in one piece from concrete are provided at both ends with plate-like end portions which are connected together by way of a central shaft portion. The end plate portions are desirably of circular shape but they may also be of other shapes such as oval, square, rectangular or the like. The shaft portion may have at least one peripheral groove at its transition to the respective end plate portions. Reinforcing bars may be fitted into such a groove in the proper relative position. Two adjacent grooves permit the reinforcing bars to be disposed in a mutually crossing relationship.

The contact surfaces of the connecting or tie members are desirably formed with a counterpart configuration relative to the engagement means on the side wall portions in order to provide a good and firm connection therebetween. As will be described in greater detail hereinafter with referece to a specific embodiment, the engagement means on the side wall portions may be formed by at least substantially equally spaced-apart grooves which extend from top to bottom of the respective side wall portion and which are distributed over the entire inside surface thereof; in that configuration, the contact surfaces on the end plate portions of each tie member are of a suitably matching shape, with grooves and projections disposed in an alternate array. Even if the grooves for example in the side wall portions are of an undercut configuration, the corresponding projections on the end plate portions of the tie members may be of square or rectangular configuration so that they can be easily fitted into such grooves, a high level of strength in the connection between the tie member and the respective side wall portion being achieved by virtue of an adhesive join being formed over a substantial surface area. By virtue of the continuous nature of the grooves in the side wall portions, the tie members can be mounted thereto in the respectively desired position and at the respectively desired height, simply by virtue of being slid along the appropriate groove to the appropriate height. When the end plate portions are mounted to the respective side wall portion in such a way that they bridge over the vertical or horizontal gap between formwork assemblies, they also serve at the same time for connecting adjacent assemblies together. A plurality of such assemblies may be joined together at the same time at the point of meeting as between a horizontal and a vertical gap.

The tie members may also be in the form of two plate portions which form the surfaces for contacting the respective side wall portions, with the plate portions being suitably connected together for example by way of tie struts in the form of wires or flat elements, preferably disposed in mutually crossed configuration. In that respect, it may be important to produce a certain spring effect which helps to avoid the side wall portions being subjected to an abrupt loading when the concrete is being poured into the assembly, thereby to ensure that the tie members are not torn out of the side wall portions.

In order to enhance the adhesion between the side wall portions and the concrete once it has set, a development of the invention provides that the side wall portions may be provided on their internal surface with channel-like recesses or elongate raised portions which preferably extend parallel to the narrow sides of the side wall portions. Raised portions may be used more particularly when the engagement means on the side wall portions comprise raised portions co-operable with the appropriate tie members, as in the way the thickness of the side wall portions and thus the amount of space required for transportation and storage is not additionally increased. When the engagement means on the side wall portions comprise depressions or recesses, then channel-like depressions are preferably also provided on the side wall portions to enhance the adhesion between them and the concrete. In addition, the side wall portions may be provided on their outward surfaces with a grid configuration or pattern which may be of a raised or depressed nature, to permit parts of the components making up the formwork assembly to be cut up or in some other way separated, at the precise dimensions required, on the building site itself. Thus, it is possible to provide a cross grid or a pattern comprising parallel vertical lines. The depth of the channels or grooves forming the pattern or the height of the land portions formed thereby only have to be of such a magnitude as to provide a ready guide and to be easily located for the operation of cutting the component to size The grooves and projections which are provided at the edges of the side walls portions for securing them together in the correct relative positions are of an undercut configuration, in accordance with a particularly advantageous development of the invention, thus giving a connection between adjacent side walls which is capable of withstanding a tensile loading therebetween. That applies both in regard to connecting formwork assemblies which are fitted one upon the other, building therefore in a vertical direction, and also in regard to the connection between such assemblies which are disposed side by side, building therefore horizontally. When such a form of connection is provided, there is then no longer the risk that, after a wall which extends over the height of the story has been erected or after an entire story wall has been built but before concrete is poured thereinto, a strong wind or storm or like conditions may cause the structure to collapse. The projections may be of a dovetail-shape crosssection with suitably adapted grooves, rounded edges on that construction being particularly desirable. It is also possible for the projections to comprise a first portion which is of an approximately circular cross-sectional shape and which is connected to the main body of the side wall portion by way of a short neck or connecting part. The grooves are then of a complementary configuration. A rounded structure of that kind has the advantage that any fouling due to concrete which may for example be left thereon, which may readily occur under the operating conditions to be found on a building site, can be more easily removed.

Another embodiment of the invention may also provide that, at their upper and lower edges, the side wall portions are provided with blind holes of T-shaped cross-section, with the holes being open towards the inside of the side wall portions, for retainingly accommodating end plate portions on suitable tie members. The blind holes may be comparatively close to the inside surface of the side wall portions so that the latter are not seriously weakened thereby. The depth of the blind holes may correspond to half the dimension of the end plate portions on the tie members so that half of an end plate portion is disposed in one side wall portion while the other half is in the side wall portion which is disposed directly thereabove. The end plate portions on the tie members are desirably of a square configuration and are connected by way of a bar of square or rectangular cross-section. The tie members can then be turned alternately through 90° relative to each other, thereby giving a higher degree of torsional stiffness. The cross-section of the blind holes is then to be suitably adapted to that arrangement. The end plate portions on the tie members may comprise for example sheet metal, while the connecting bars may be welded wires. A further development in that arrangement provides that two tie members each having two end plate portions are connected in the region of their connecting bars, between the end plate portions. When the connecting bars are joined together in that way at their centres, the result is a X-shaped tie member which again has a certain spring action. In addition, the distance between each two double tie member assemblies of that kind, at the centre of the respective wall portion, is increased by virtue of the X-like configurations, so that pipes or tubes of larger crosssection, being for example 100 mm in diameter, may be easily pass therebetween.

Where formwork or shuttering assemblies meet each other in end-to-end relationship, for example along the major part of a wall to be built, there is no need for end wall portions or panels at the ends of the respective assemblies. However, at the corners of a building, at junctions between outer and inner walls and for example at window openings or door apertures, the assemblies must be closed off at their ends. Therefore, it is only at such locations that end wall portions or panels, or intermediate wall portions, need to be used. The end wall portions may either be secured in position by adhesive means in a flush abutting condition, or they may be provided at their side edges which butt against the side wall portions, with positioning elements co-operable with corresponding elements of a complementary configuration on or in the side wall portions. The positioning elements may comprise for example pins, with associated bores, or grooves with associated projections. When adhesive is used, it is desirable not to provide any undercut configuration so that the end or intermediate wall portions can be simply pressed into place and do not have to be slid or otherwise pushed into position, for if that were to be the case, the adhesive used would be pushed off the component as it was slid into the appropriate position.

The assemblies according to the invention may be adapted to virutally any practical requirements by means of just one kind of side wall portion, with associated tie members, and just one end wall portion. There is therefore no need to use special corner comonents and other connecting elements of various shapes. In addition however it is also possible for the side wall portions to be used as heat barrier or thermal insulation panels. Such insulating panels may also be laid as roof insulating panels on or under the roof joists or rafters. The way in which the panel portions fit together by positive interengagement permits operation to be carried out quickly and neatly. The panels may be of comparatively great length, being for example 2 meters in length, because the formwork assemblies may also be of a correspondingly large size. In a similar fashion, the heat insulation panels may be laid on a floating floor and may possibly carry pipes or tubes of a floor heating system. The heat insulation panels may also be mounted on the outside or the inside of buildings.

When using the side wall portions discussed above, wherein the engagement means are formed by at least substantially equally mutually spaced grooves which extend from top to bottom and which are distributed over the entire inside surface of the side wall portions, the grooves thereof are disposed upwardly and in the direction of fall of the roof when they are employed as roof insulating panels, so that any water which penetrates into the grooves or which condenses on the panels can run off to the eaves. When such side wall portions are used as floor panels on which heating tubes or pipes are possibly laid, the side bearing the grooves is disposed downwardly in order to provide for better footstep sound insulation. In addition, when using gypsum or adhesive mortar, the grooves permit the side wall portions to be subsequently fitted in position as inside or outside wall insulation.

For the purposes of securing the thermal insulation panels to a wall to be insulated thereby, it is also possible to use holders which are of a configuration approximately corresponding to one end of an above-mentioned tie member, wherein the holders co-operate with the engagement means on the side wall portion forming the thermal insulation plate, and can be secured to the wall. For the purposes of properly positioning the holders, use is desirably made of a template or jig arrangement. The holders advantageously have a base portion providing a contact surface with a ball portion thereon, which is capable of engaging into a ball socket in the side wall portions. When the side wall portion is used as a thermal insulation panel for insulating floor heating systems, it is preferable to use holder means for the pipes or conduits of the floor heating system, which are of a configuration corresponding to one end of the above-mentioned tie member and which co-operate with the engagement means on the side wall portions.

For the purposes of securely and easily fixing the pipes or conduits in position, the holder means may have a ball portion which is capable of engaging into a ball-receiving socket in the side wall portion forming the thermal insulation plate and which is joined to a head portion provided with a bore for receiving the pipe or conduit, the ball having a slot which extends therethrough and into the bore. With such an arrangement, the holder can be bent open, by opening the slot, so that it can be fitted over the pipe or conduit by passing the latter through the slot, with the holder then being held in the position of being closed around the pipe or conduit by the ball portion thereof being engaged into a socket.

When the material used for the assembly according to the invention is a hard foam, it is preferable to use a fire-retardant hard foam of class F in order to eliminate the danger of fire.

Further objects, features and advantages of a formwork assembly according to the present invention will be more clearly apparent from the following description of preferred embodiments.

BRIEF DESCRIPTION OF THE DRAWINGS

FIG. 6 shows a modified embodiment of the side wall portion of an assembly, FIG. 7 shows a sectional view of part of a further embodiment of a tie member showing the way in which it is fixed in a side wall portion, FIG. 15 shows a further embodiment of an assembly according to the invention, FIG. 16 shows a corner connection using assemblies and tie members as shown in FIG. 15, FIG. 17 shows a T-shaped junction using assemblies and tie members as shown in FIG. 15, and FIG. 18 shows a roof or ceiling termination using assemblies and tie members as shown in FIG. 15.

DESCRIPTION OF PREFERRED EMBODIMENTS

Figure 1:
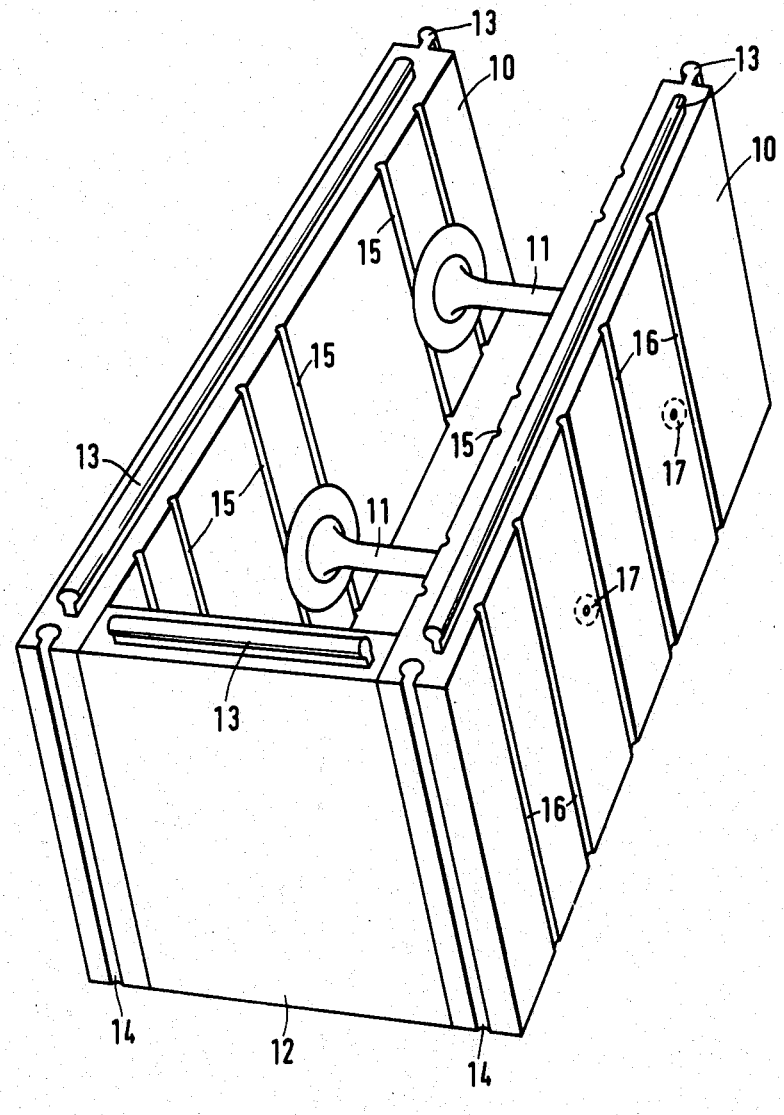
FIG. 1 shows a perspective view of an embodiment of a formwork or shuttering assembly according to the invention.

Referring firstly to the perspective view shown in FIG. 1 of an embodiment of a shuttering or formwork assembly, which may also have a cladding action as described hereinafter, in accordance with the present invention, the assembly comprises two side wall portions 10 comprising fire-retardant hard foam material which are connected together in at least substantially parallel relationship by way of two connecting members shown as tie members or bars 11, and an end wall portion 12. For the purposes of connecting together assemblies of the same nature which are disposed in side-by-side relationship or in superposed relationship, by a positive mechanical interengagement, the upper and lower edges as well as the end edges of the side wall portions 10 and the upper and lower edges of the end wall portion 12 are provided with projections in the form of elongate web portions 13 and grooves 14 of a complementary shape. The cross-section of the projections 13 and the grooves 14 is defined by a circular portion and a short neck or joining portion adjacent thereto. For the purposes of fitting the wall portions together, the projections 13 are fitted into the appropriate grooves 14 as by being slid thereinto.

Provided in the inwardly facing surfaces of the side wall portions 10 are channel-like recesses or depressions 15 which may possibly also be of an undercut configuration, being for example of a dovetail-like shape, and which provide for additionally securing the side wall portions to the concrete which is poured into and which sets in the assembly defined by the side and end wall portions. Provided on the outwardly facing surfaces of the side wall portions 10 are markings in the form of shallow channels 16 which permit the wall portions to be more easily cut up or in some other way separated at the appropriate dimensions. Reference numeral 17 denotes the marking points which mark the position of the tie members 11.

Figure 2:
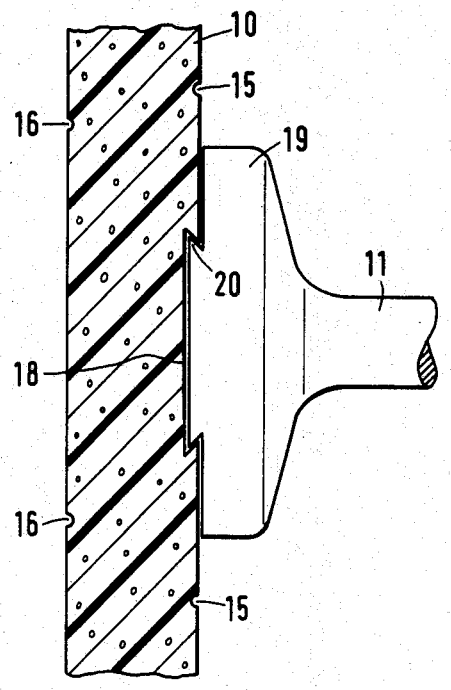
FIG. 2 is a diagrammatic cross-sectional view of part of the assembly in the region of the junction between tie member and a side wall portion.

FIG. 2 shows an embodiment of the engagement means whereby the side wall portion 10 and a tie member 11 are positively interconnected. As illustrated, the side wall portion has a shallow recess or depression 18 with an undercut edge configuration, thus defining a generally dovetail-like cross-section, while the tie member 11 has a base or end portion 19 with a complementary raised portion or projection 20 which is also of a complementary configuration, so that it can be fitted into the recess 18 by a snap-in or clipping action, thereby being held in latching engagement therein. The configuration of the components is such that after the tie member has been brought into snap-in engagement with the side wall portion, there is a certain tensile stress therebetween whereby the tie member 11 is held in a position of bearing firmly against the wall portion 10. If, before the tie member 11 and the wall portion 10 are fitted together, the surfaces thereof which come into contact with each other are sprayed with adhesive, that provides a very secure connection therebetween, which has a high degree of tensile strength.

Figure 3:
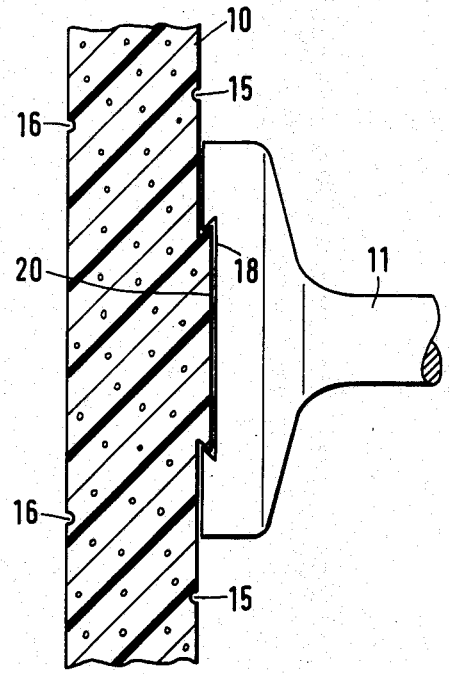
FIG. 3 shows a construction which is of a complementary configuration to that shown in FIG. 2.

FIG. 3 shows an embodiment of the connecting means between the tie member 11 and the side wall portion 10, which is complementary to that shown in FIG. 2, insofar as the portion 19 of the tie member 11 has the shallow recess or depression 18 while the wall portion 10 has the corresponding projection 20.

Figure 4:
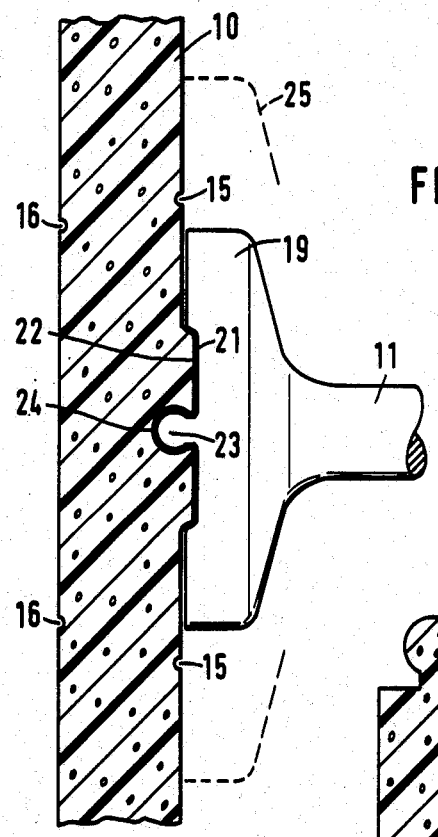
FIG. 4 is a view of a modified embodiment of a junction between a tie member and a side wall portion.

Reference will now be made to FIG. 4 showing another embodiment of the connection formed by suitable engagement means between the side wall portion 10 and the tie member 11. The portion 19 of the tie member 11 has a central shallow recess 21 while the wall portion 10 is provided with a corresponding raised portion or projection 22. Disposed in the centre of the recess 21 is a ball portion 23 which can be latchingly engaged into a ball-receiving socket 24 by being simply pressed thereinto. In this case also, after the ball 23 and the socket 24 have been brought into latching interengagement, there is also a residual tensile stress therebetween so as to ensure that the components are securely fitted in position and are firmly secured together by the adhesive. In order better to distribute the loadings involved and to increase the surface area which can form the adhesive join, the portion 19 of the connecting member 11 may be provided with enlargements 25 as indicated in broken lines in FIG. 4.

Figure 5:
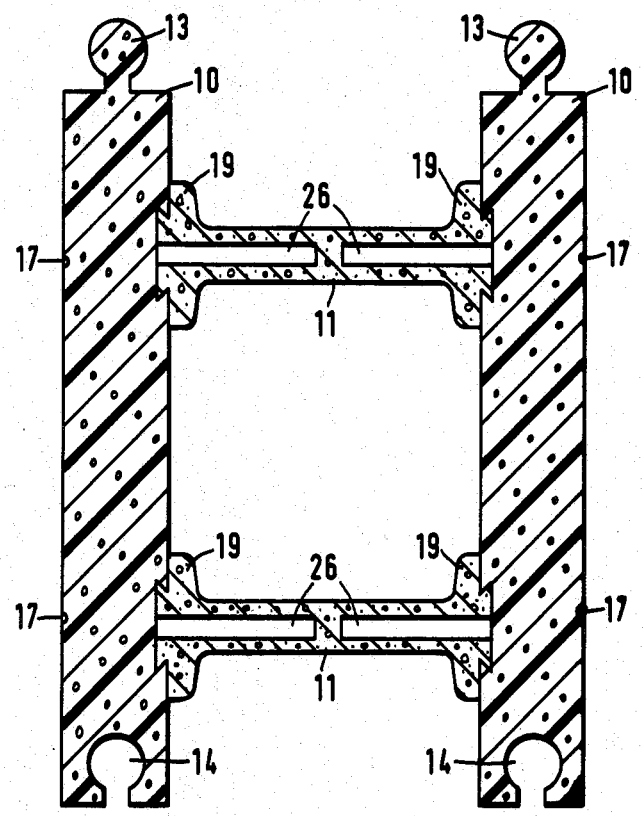
FIG. 5 is a cross-sectional view through an assembly as shown in FIG. 1, in the region of the tie members.

FIG. 5 shows a view in cross-section through the assembly in FIG. 1. Two tie members 11 which are disposed one above the other are connected to the side wall portions 10 by engagement means, as in the embodiment illustrated in FIG. 2. In the FIG. 5 embodiment, the tie members 11 comprise concrete and have central bores 26 which extend thereinto from both ends, in coaxial relationship therewith, and which terminate at a spacing from each other of a few centimetres. The centering points 17 on the outside of the side wall portions 10 in FIG. 1 mark the positions of the bores 26 so that the portion of concrete which remains between the mutually adjacent ends of the bores 26 can be subsequently drilled through to permit conduits or cables to be passed therethrough, or to permit fixing and supporting elements to be introduced.

A modification of the side wall portion 10 is shown in FIG. 6. Instead of being provided with individual recesses or depressions 18 as shown in FIG. 2, which are for example of circular configuration, this form of the side wall portion has grooves 58 which are of a dovetail-shaped configuration and which extend from the top edge of the wall portion but which terminate short of the lower edge thereof. Connecting members or tie members 11 with a base portion of corresponding configuration can be fitted into the grooves 58 and additionally secured therein by adhesive means, in certain positions which are identified by suitable markings (not visible in FIG. 6). The remaining free portions of each groove 58, being therefore not occupied by a respective tie member 11, provide for additionally securing the side wall portion 10 to the concrete which is poured into and sets in the assembly.

The embodiment shown in FIG. 7 uses a connecting member or tie element 31 which comprises two end plate portions 27 and strut members such as wires or bars as indicated at 28 which interconnect the end plate portions 27. The end plate portions 27 are engaged into a recess 18 in the side wall portion 10, in a similar fashion to the embodiment shown in FIG. 2, and are additionally secured therein by adhesive. The wires or bars 28 can be easily welded to the end plate portions 27 which comprise sheet metal. The mutually crossing configuration of the wires provides a certain spring action thereby reducing the shocks or impacts produced when the shuttering or formwork assembly is filled with concrete.

Figure 8:
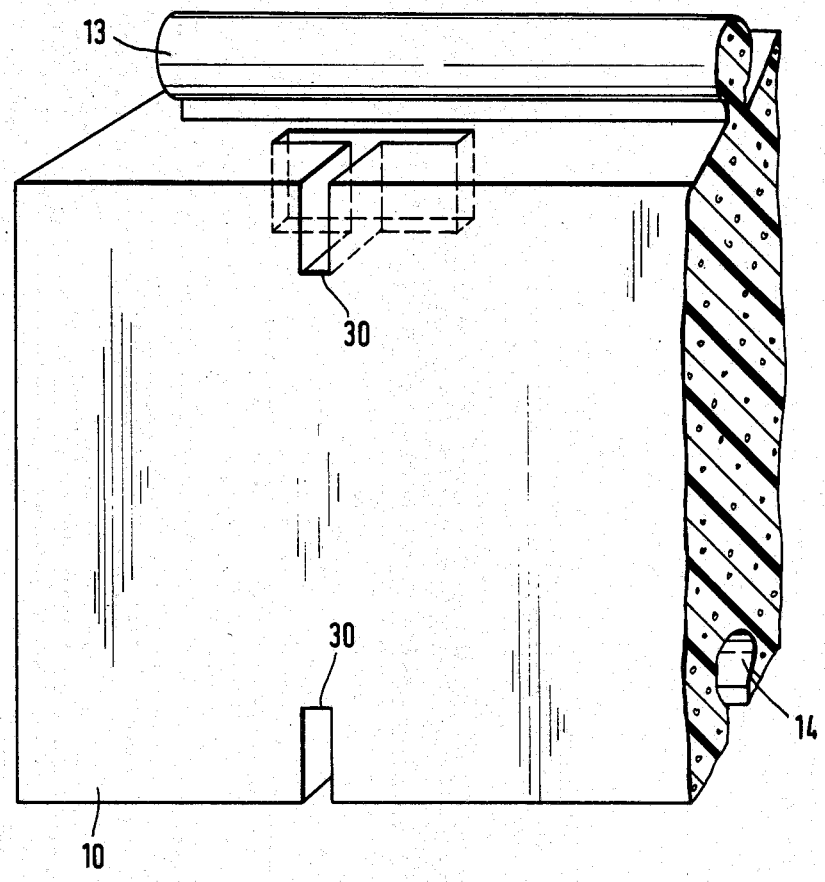
FIG. 8 is a perspective view of another embodiment of a side wall portion of an assembly.
Figure 9:
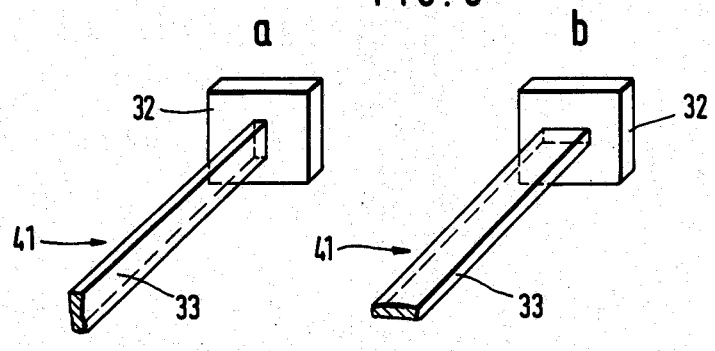
FIG. 9 shows tie members used with the side wall portion shown in FIG. 8.

In the embodiment shown in FIG. 8, the side wall portion 10 which is shown in perspective in provided with engagement means in the form of blind holes 30 which are of T-shaped cross-section as viewed from the top of the side wall portion shown in FIG. 8. The holes 30 are provided at the upper and lower edges of the side wall portion 10. The holes 30, being comparatively shallow, do not cause serious weakening of the side wall portion 10, but they permit tie members 41 as shown in FIG. 9 to be easily fitted thereinto. Each tie member 41 comprises an end plate portion 32 of square shape, and a connecting bar 33 which is of rectangular shape. In order to increase the torsional stiffness of the assembly, the connecting bars 41 are fitted alternately in the respective positions shown in FIGS. 9*a* and 9*b*, in which one bar is turned about its longitudinal axis through 90° relative to the other. The holes 30 must be suitably adapted to the turning of the bars, in a manner which is not shown, in regard to connecting them to the inside surface of the side wall portion 10.

Figure 10:
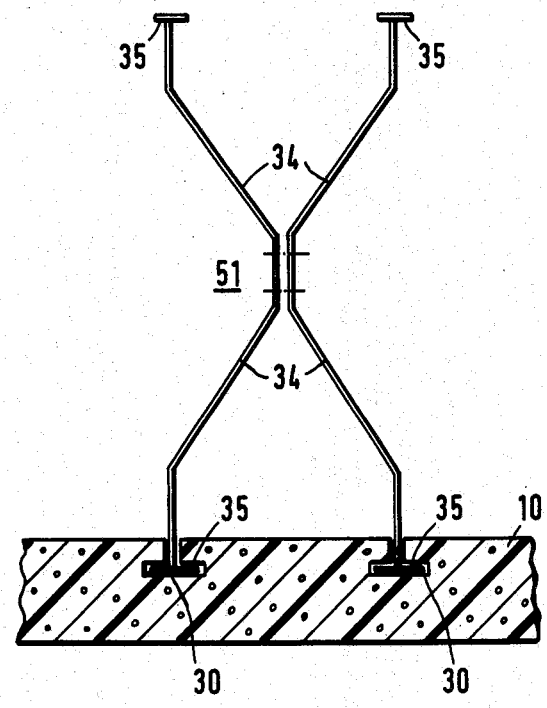
FIG. 10 shows a view of a further embodiment of a double tie member.

Reference is now made to FIG. 10 which shows a tie member 51 in the form of a double tie assembly. Two cranked connecting wires 34 carry respective plate portions 35 at their ends, such plate portions 35 being of a similar nature to the plate portions 32 shown in FIG. 2. The plate portions 35 are disposed in the blind holes 30 shown in FIG. 8. At their centre, the wires 34 are connected together in the manner shown diagrammatically in FIG. 10, for example for screw means, welding, riveting or the like. That therefore provides a double tie assembly 51 which is of a generally X-shape and which once again has a certain spring action and can thus absorb shocks and impacts.

Figure 11:
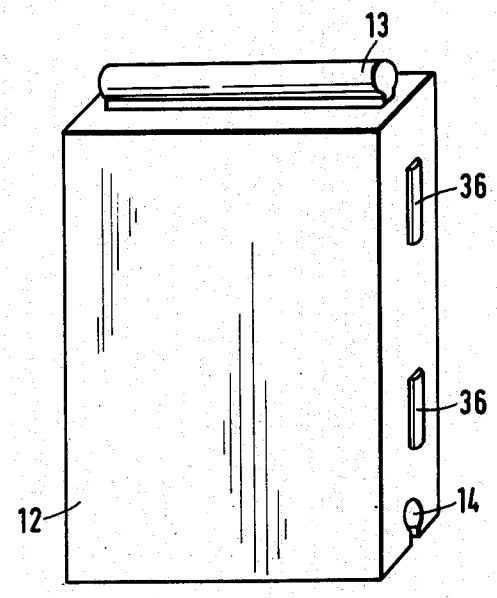
FIG. 11 is a perspective view of an embodiment of an end or intermediate wall portion.

FIG. 11 shows the end wall portion 12 of the embodiment illustrated in FIG. 1, separately. The end wall portion 12 carries lateral projection portions 36 in the form of raised beads or the like which, co-operating with corresponding depressions or recesses (not shown) on the inside of the side walls 10, permit the wall portions 10 and 12 to be accurately positioned relative to each other.

Figure 12:
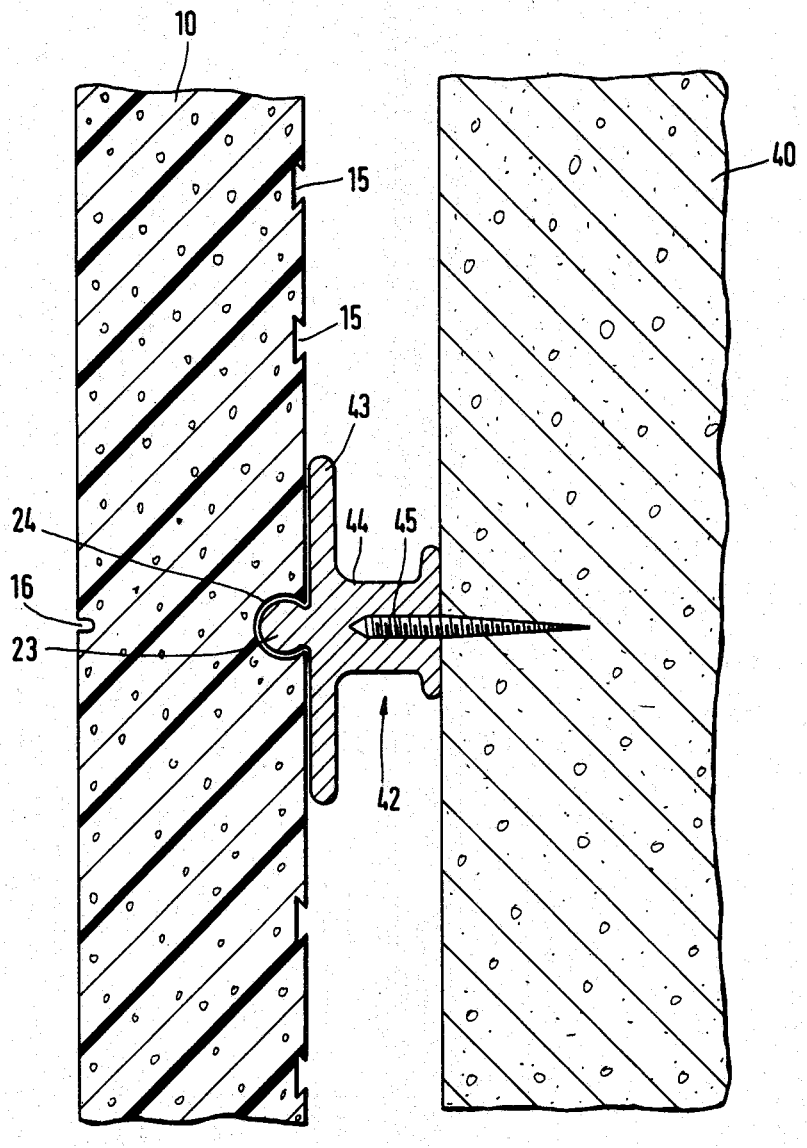
FIG. 12 is a diagrammatic view in cross-section of part of the arrangement for securing a thermal insulation panel or plate to a wall to be insulated.

FIG. 12 shows the way in which a side wall portion 10, being used as a heat barrier or thermal insulation panel, is secured to the wall 40 of a building which is to be insulated in that way. The wall portion 10 has a ball-receiving socket 24 which is similar to the configuration shown in FIG. 4 for example. In the FIG. 12 embodiment, the socket 24 is formed directly in the wall portion 10, without the additional provision of a raised portion as indicated at 21 in FIG. 4. The ball portion 23 on a holder 42 engages into the socket 24, with a flange 43 on the holder bearing against the surface of the wall portion 10. It is additionally possible to provide for adhesive in the region of the flange 42 and the ball portion 23. Adjoining the flange 43 of the holder is a leg or body portion 44 which contains a screw 45 with which the holder 42 can be screwed into the wall 40. The spacing defined by the holder 42 between the wall portion 10 and the wall 40 provides additional ventilation and insulation, which is often desired.

Figure 13:
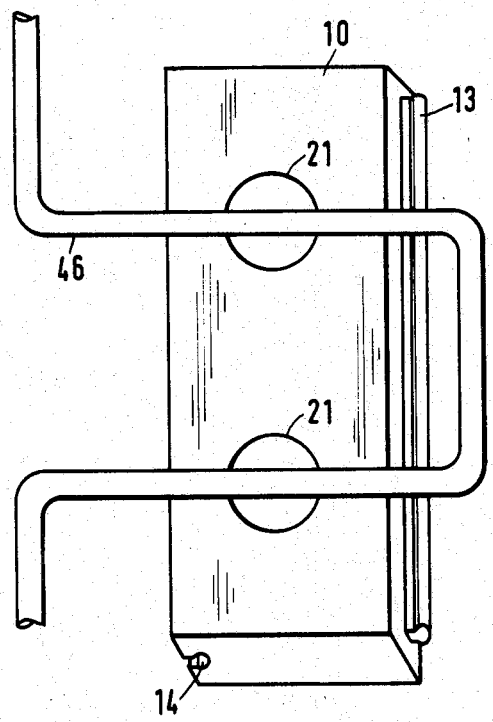
FIG. 13 is a diagrammatic view of a section of a floor insulating plate or panel with a floor heating system pipe fixed thereon.
Figure 14:
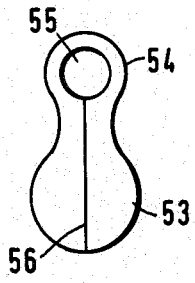
FIG. 14 shows a holder device for securing the pipe of a floor heating system as shown in FIG. 13.

Reference will now be made to FIG. 13 showing use of a side wall portion 10 as a floor insulation panel carrying a pipe 46 of a floor heating system. The pipe 46 can be secured in precisely the correct position at the engagement means in the form for example of projections 21 as shown in FIG. 4, although such engagement means are only shown in highly diagrammatic form in FIG. 13. For that purpose, a securing element as shown in FIG. 14 can be used. The FIG. 14 element has a ball portion 53 which is similar to the ball portion 23 shown in FIG. 4, while adjoining same is a head portion 54 having a bore 55 for accommodating the pipe 46. A slot 56 extends through the ball portion 53 to the bore 55 so that the two halves of the ball portion 53, on respective sides of the slot 56, can be bent apart and the element thus opened so that in that way the pipe 46 can be introduced into the bore 55 through the slot. The ball portion 53 is then pressed in a ball socket (not shown) corresponding to the socket 24 in FIG. 4, whereby the two halves of the ball portion 53 are held in the closed condition shown in FIG. 14.

In the embodiment shown in FIG. 15, the side wall portions 10 are provided with grooves 60 in an alternate array distributed over the whole of the inside surface of each side wall portion. Each groove 60 is enlarged in cross-section at its bottom part and is therefore in the form of a somewhat rounded-off dovetail-like configuration. The portions or lands 61 remaining between each two adjacent grooves 60 are of a crosssection which is complementary to that of the grooves 60. The connecting elements or tie members 11 which interconnect the side wall portions 10 in the FIG. 15 embodiment are desirably made in one piece from concrete. They have plate-like end portions 62 whose outside surfaces have webs or elongate projections 63 which engage into the grooves 60, and grooves 64 which accommodate the land portions 61. The portions 63 which may be of a continuous or an interrupted configuration are of square or rectangular cross-sections so that the tie members 11 can be brought into interfitting engagement with the side wall portions 10. That can occur virtually at any position and at any height in relation to the formwork assembly. The use of a suitable adhesive makes it possible to achieve a very high level of strength in the connection between the tie members 11 and the side wall portions 10.

Reference will now be made to FIGS. 16, 17 and 18 showing examples of possible constructions which can be formed with the side wall portions 10 and the tie members 11 illustrated by the embodiment shown in FIG. 15. No formwork assemblies of a special configuration are required for making the corner connection shown in FIG. 16. It is only necessary for a part of the side wall portion 10 to be cut away at the part indicated by reference numeral 65 so that in the wall which is subsequently produced by means of this assembly, there is no bridge of hard foam material which permits fire to be transmitted through the wall. To achieve the necessary strength in the assemblies formed by the side wall portions 10 and the tie members 11, to resist their being burst open when the concrete is poured in, the tie members 11 are taken as far as possible into the corner, in which respect, as illustrated, a tie member may also partly project into the opening 65. The tie member 11 which is shown at the bottom in FIG. 16 bridges over the gap between two mutually adjacent assemblies and accordingly forms a connection at that location. An end member 66 closes off the corner from the exterior. The end member 66 has the same grooves 60 and projections 61 as the side wall portions 10, at the edges, as shown in Figure 15, and can therefore be fitted into the side wall portions, forming a force-locking connection therebetween. The grooves 60 and projections 61 on the end member 66, which face inwardly of the formwork assembly, like the free grooves 60 and projections 61 on the side wall portions 10, provide a resilient cushioning effect which, when the concrete is poured into the assembly, damps the dynamic forces which occur under those circumstances.

Reference will now be made to FIG. 17 which shows a T-shaped junction between shuttering or formwork assemblies as shown in FIG. 15. In this case also, there is no need for any special construction to form the T-junction. It is only necessary for a part of the side wall 10 to be removed at the point of junction at 67, so that once again there is no danger of fire being transmitted through the wall structure at that point. The tie members 11 are taken closely up to the location 67 or project slightly thereinto, in order to provide the required strength at that point.

Reference is now made to FIG. 18 showing a diagrammatic view of a roof or ceiling termination using assemblies as shown in FIG. 15. When the required wall height is reached, and concrete has been poured into the formwork assemblies, as indicated by reference numeral 70, the upper part of the side wall portion 10 of the uppermost assembly, being the side wall portion 10 which is inwardly of the room defined by the wall structure, is removed as indicated at 69, by a distance corresponding to the thickness of the roof or ceiling structure which is shown in broken lines at 68. Before the structure 68 is fitted in position, if necessary, the upwardly projecting part of the end portion or plate 62 of the uppermost tie member 11 can be removed as by being knocked off.

In regard to the tie members used in the constructions shown in FIGS. 16 to 18, the tie member 11, as shown in FIG. 15, may be provided with two peripheral grooves 71 extending around the shaft or central portion thereof, at the transition between the shaft or central portion and the plate-like end portions 62. Horizontal and/or vertical reinforcing bars 72 can thus be fitted into the grooves 71, to provide extra location for the bars and to further stiffen the structure.

The foregoing description speaks of "sticking" or "adhering", which should be understood as follows: Hardfoam plastic on the basis of polystyrene (f.i. Styroper R) is very sensitive against shrinking of the cellular walls of the foam plastic, when a solvent for polystyrene is applied to. Normal adhesives for polystyrene therefore do not contain a solvent, which could attack polystyrene. Within the scope of the present invention, an adhesive is used containing a solvent for polystyrene thinned to an extent or being weakly effective so that the cellular walls of the polystyrene begin to become sticky and flexible, yet do not collapse. This makes it possible to smoothen the surface of the polystyrene body and to equate to the surface of the stems 11, 31, 41, 51. Furthermore, the surface of the foam plastic body becomes more rigid, since the globulites of the foam plastic have a tendency to better melt together so that a welded surface of the foam plastic is provided in the region of the adhering interface.

It is to be understood that the solvent in the adhesive is to be applied in a controlled manner. Generally, this means thinning the adhesive with a pasty fillter that can consist on the basis of cellulose, acrylic resin or polyester resin and so on. The filler is also effective to fill interspaces between the elements to be connected. The consistency of the adhesive can be adapted to the method of applying as spraying, brushing or coating with spatula.

The adhesive can be applied to the stem or the foam plastic or on both parts. Different adhesives can be used to be applied on the stem and on the foam plastic, especially components of a two-component adhesive can be used. If both surfaces to be connected are treated with adhesive, the consistency of the adhesive for the first surface, f.i. of the stem, can be different to the consistency of the adhesive for the second surface, that is of the foam plastic. As an example, the first surface is sprayed with an aerosol, whereas the second surface is coated with pasty material, which is also good for correcting differences between the surfaces to be connected.

The fillers can be made of plastic scrap, so that the adhesive composition according to invention can be produced economically.

It will be appreciated that the foregoing embodiments are described solely by way of example of the assembly according to the invention and further modifications and alterations may be made therein without departing from the scope of the invention.

What is claimed is:

1. A formwork assembly useful for producing a wall structure, comprising:

a plurality of side wall portions each including adjacently disposable edges, and recess and projection means disposed at said edges for positionally securing said wall portions to one another;

a plurality of connecting members for interconnecting said side wall portions; and at least one reinforcing member disposable between said side wall portions when interconnected by said connecting members;

wherein said of said side wall portions includes an inwardly facing surface and first engagement means disposed on said surface, and said connecting members comprise second engagement means cooperable with said first engagement means for securing said connecting members to said side wall portions; and wherein said connecting members each additionally comprise a pair of opposed circular end portions and a central shaft portion connecting said end portions, said shaft portion including at least one peripheral groove disposed adjacent said end portions and being dimensioned to supportively contact said reinforcing member wherein each circular end portion has an outwardly facing surface, said surface having at least two planes which are parallel to each other and to the reinforcing member so that substantially the entire outwardly facing surface of each end portion flatly abuts against its associated side wall portion.

2. An assembly as set forth in claim 1, wherein said connecting member comprises concrete.

3. An assembly as set forth in claim 1 wherein said first engagement means comprises substantially equally spaced-apart grooves which extend at least substantially continuously from top to bottom of said side wall portion and which are distributed over the entire inside surface thereof.

4. An assembly as set forth in claim 3 wherein each said groove is enlarged in width at the bottom thereof.

5. An assembly as set forth in claim 3 wherein the crosssectional configuration of said grooves is complementary to the crosssectional configuration of a respective land portion between each two adjacent grooves.

6. An assembly as set forth in claim 1 wherein each said connecting member has at least one contact surface which is formed as a counterpart to the first engagement means on a respective said side wall portion.

7. An assembly as set forth in claim 6 wherein said connecting member comprises concrete at least in the region of said at least one contact surface.

8. An assembly as set forth in claim 7 wherein said connecting member has at least one reinforcing member at least in a middle region thereof.

9. An assembly as set forth in claim 7 wherein said connecting member comprises bores which extend thereinto in coaxial relationship from respective ends thereof, said bores terminating at a small spacing from each other.

10. An assembly as set forth in claim 1 wherein surfaces of said connecting members and said side wall portions, which are in contact with each other, are secured together by adhesive means.

11. An assembly as set forth in claim 1 wherein said side wall portion is provided on its outward surface with a locating pattern formed by recess means.

12. An assembly as set forth in claim 1 and further including at least one end wall portion extending between two said side wall portions which are in a side-by-side relationship.

13. An assembly as set forth in claim 12 wherein said end wall portion is provided at upper and lower edges with groove means and projection means of undercut configuration.

14. An assembly as set forth in claim 13 wherein said end wall portion is provided with positioning elements at its side edges which in the assembled condition of a plurality of side wall portions and end wall portions butt against said side wall portions, said positioning elements co-operating with elements on said side wall portions of a complementary configuration.

15. An assembly as set forth in claim 1 wherein a said side wall portion is used as a heat barrier panel member.

16. An assembly as set forth in claim 15 which is capable of being secured to a wall structure by holder means which is of a configuration corresponding to an end portion of a said connecting member and which is co-operable with said first engagement means on a said side wall portion and which provides means for securing said holder means to a said wall structure.

* * * * *

UNITED STATES PATENT AND TRADEMARK OFFICE

CERTIFICATE OF CORRECTION

PATENT NO. : 4,655,014

DATED : April 7, 1987

INVENTOR(S) : Edmond D. Krecke

It is certified that error appears in the above-identified patent and that said Letters Patent is hereby corrected as shown below:

Col. 3, line 11, delete "therewiht" and insert --therewith--.

Col. 3, line 17, delete "provide" and insert--provides--.

Col. 4, line 17, delete "join" and insert --joint--.

Col. 4, line 19, delete "join" and insert --joint--.

Col. 5, line 18, delete "join" and insert --joint--.

Col. 6, line 3, delete "join" and insert --joint--.

Col. 6, line 38, delete "the" first occurrence and insert --that--.

Col. 7, line 55, delete "pass" and insert --passed--.

Col. 8, line 17, delete "comonents" and insert -com-ponents--.

Col. 11, line 16, delete "can form" and insert --forms--.

Col. 11, line 17, delete "join" and insert --joint--.

UNITED STATES PATENT AND TRADEMARK OFFICE

CERTIFICATE OF CORRECTION

PATENT NO. : 4,655,014

DATED : April 7, 1987

INVENTOR(S) : Edmond D. Krecke

It is certified that error appears in the above-identified patent and that said Letters Patent is hereby corrected as shown below:

Col. 12, line 28, delete "That" and insert --the arrangement--.

Col. 14, line 50, delete "smoothen" and insert--smooth--.

Col. 14, line 59, delete "fillter" and insert --filler--.

Col. 14, line 60, delete "on the basis".

Col. 15, line 31, delete "said" first occurrence, and insert --each--.

Signed and Sealed this

Fifteenth Day of March, 1988

*Attest:*

*Attesting Officer*

DONALD J. QUIGG

*Commissioner of Patents and Trademarks*